United States Patent [19]

Ivarsson

[11] Patent Number: 4,947,515

[45] Date of Patent: Aug. 14, 1990

[54] NOZZLE FOR REMOVING PAINT

[75] Inventor: Per A. Ivarsson, Nyköping, Sweden

[73] Assignee: Aktiebolaget Electrolux, Stockholm, Sweden

[21] Appl. No.: 254,104

[22] Filed: Oct. 6, 1988

[30] Foreign Application Priority Data

Oct. 7, 1987 [SE] Sweden ..... 8703861

[51] Int. Cl.[5] ..... A47L 9/06

[52] U.S. Cl. ..... 15/401; 15/236.01; 15/322

[58] Field of Search ..... 15/401, 402, 322

[56] References Cited

U.S. PATENT DOCUMENTS

| | | | |
|---|---|---|---|
| 2,879,530 | 3/1959 | Ego | 15/401 X |
| 3,797,066 | 3/1974 | Zaidan | 15/402 X |
| 4,502,179 | 3/1985 | Coughlin et al. | 15/322 |
| 4,549,329 | 10/1985 | St. Clair | 15/322 X |
| 4,584,786 | 4/1986 | Gremminger | 15/322 |
| 4,630,329 | 12/1986 | Shores | 15/402 X |

*Primary Examiner*—Chris K. Moore

*Attorney, Agent, or Firm*—Pearne, Gordon, McCoy & Granger

[57] ABSTRACT

This invention relates to a nozzle which via a hose is connected to a vacuum source for removing to a collecting container dissolved and scraped away paint residues from previously painted surfaces. The nozzle comprises a base part (10) being connected to the hose, said base part having an opening (11) through which air, together with the dissolved paint residues, are sucked. The base part has supply means (13) for liquid through which i.e., for example, water is supplied to the nozzle in order to promote the transportation of the paint residues through the hose, and a control device (15) by means of which the liquid supply to the nozzle can be adjusted. The nozzle also comprises a tool or tool holder (18) which is exchangably fastened to the base part (10) and is arranged to mechanically treat the surface from which the paint residues are sucked away.

4 Claims, 1 Drawing Sheet

NOZZLE FOR REMOVING PAINT

BACKGROUND OF THE INVENTION

This invention relates to a nozzle which via a hose is connected to a vacuum source for removing to a collecting container dissolved and scraped away paint residues from previously painted surfaces.

In order to remove paint from surfaces which have been previously painted, it has been common to scrape away the paint layer manually. This work is troublesome and time consuming and during the last decades chemical agents have been developed by means of which the old paint can be dissolved and then removed from the surface. Even if these agents facilitate the manual scraping work resulting in efficient cleaning of the surface, the method instead involves drawbacks. Thus, during the work, surrounding objects have to be protected against the sticky paint residues which are scraped away, and the rinsing agent which often is applied when the paint has been removed. When working on larger surfaces such as building facades, innerwalls or the like extensive protecting measures usually have to be taken.

In order to eliminate the need for such protective measures as far as possible, and in order to achieve a better working environment, it has been suggested to use a method where in a first step a paint dissolving agent is applied on the surface which is to been cleaned and in a second step the dissolved paint, after a while, is removed from the surface by means of a suction nozzle. Since the paint residues which are sucked into the nozzle, because of their sticking consistency, have a tendency to clog in the nozzle, so in the connected hose, a lubricant has to be supplied. Water serves as such a lubricant, sometimes with additional agents. This technique is described in EP 194242.

It has however proved to be difficult to remove all paint residues solely by means of suction. Usually some kind of mechanical action is necessary in order to get the paint residues to leave to surface.

SUMMARY OF THE INVENTION

In accordance with the present invention, a suction nozzle includes a scraper and liquid supply, the scraper being used to mechanically scrape away paint residue from a surface. The liquid supply washes the scraped paint residue from the surface wherein the liquid and entrained paint residue are collected by the nozzle, which in turn is connected to a vacuum source including a paint residue collection container.

BRIEF DESCRIPTION OF THE DRAWING

An embodiment of the invention will now be described with reference to the accompanying drawing in which FIG. 1 in a perspective view shows the nozzle, whereas

DETAILED DESCRIPTION OF THE PREFERRED EMBODIMENT

Figure 1:
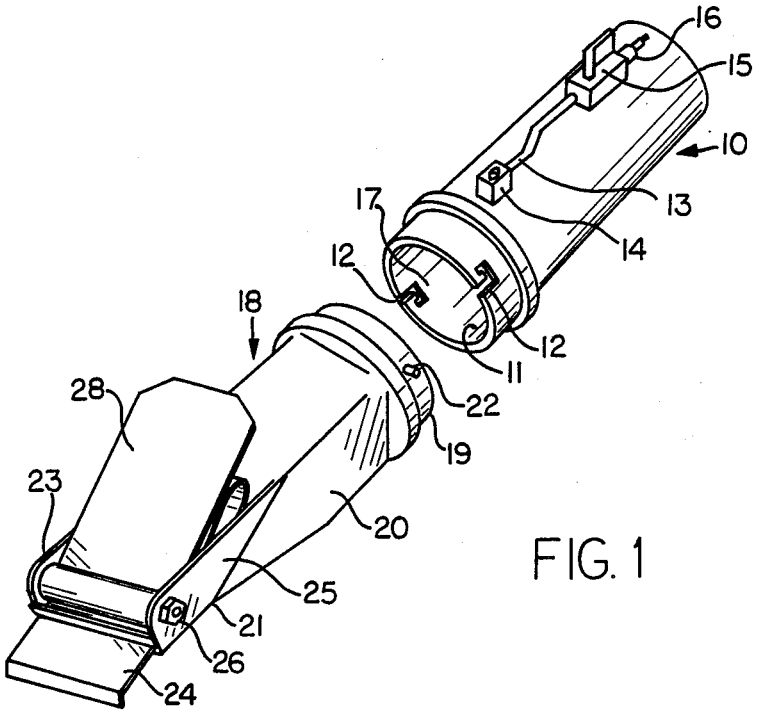

As appears from the figures, the nozzle comprises a base part 10 which via a hose, not shown, is connected to a container, communicating with a vacuum source. Paint residues are collected in the container together with the paint removing agent being used and the lubricant. The base part 10 is tube shaped and has an inlet opening 11 about which several slots 12 are arranged. Further, the base part has a supply device for liquid by means of which the lubricant referred to above can be supplied. The supply device comprises a pipe 13 with a connecting part 14 which is fastened to the base part and opens at the interior of this part. The pipe 13 is, via a valve 15, connected to a nipple 16 to which a hose, not shown, is connected to supply the lubricant. One end of the base part has an abutting surface 17 for a tool or tool holder 18. This tool holder 18 has a sleeve shaped rear part 19 which continues into a mainly box-shaped front part 20 with an elongated downwardly directed nozzle opening 21. The diameter of the rear part 19 is slightly less than the diameter of the base part 10 which means that the tool holder can be inserted into the base part. Since the rear part 19 has several extensions or pins 22 cooperating with the slots 12, the base part and the tool holder can be locked to each other.

Figure 2:
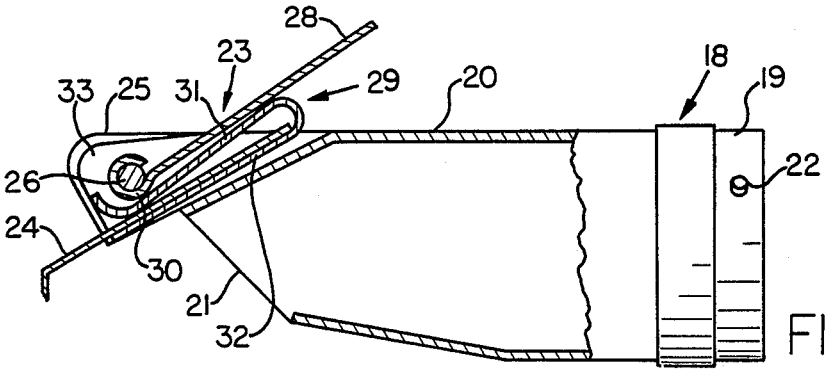
FIG. 2 is a longitudinal section through the nozzle and FIG. 3 shows the nozzle in a plan view.
Figure 3:
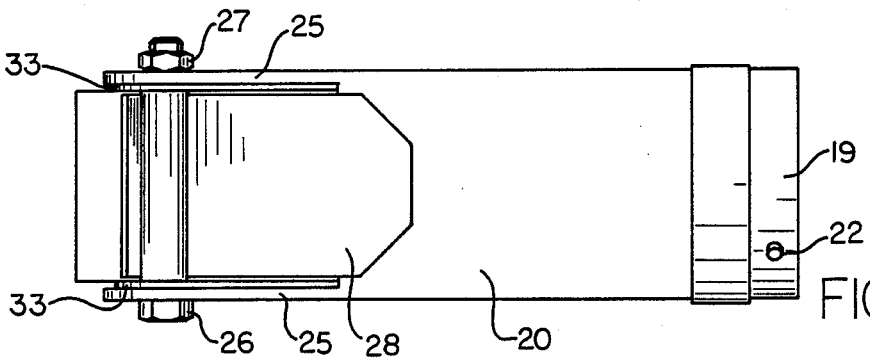

The tool holder at its front part 20 has a fastening device 23 for a scraper 24 having an outer end which is bent towards the surface. The fastening device 23 comprises two plates 25 extending upwards on each side of the nozzle, the plates having a hole for a bolt 26 extending between the two plates so that they can be moved towards each other by tightening a nut 26. Between the two plates there is a locking plate 28 and a scraper holder 29. One end of the locking plate 28 surrounds the bolt 26 so that a hinge, about which the locking plate 28 can be turned, is formed. The locking plate also has a bead 30 which when turning the locking plate forces two legs 31 and 32 of the scraper holder 29 towards each other. The scraper holder 29 is U-shaped in section, (see FIG. 2) the upper leg 31 in the area in front of the bolt 26 diverging in a direction outwardly from the second leg 32 so that the scraper 24 easily can be inserted between the two legs. The lower leg 32 is at its opposite edge parts folded 90° so that flanges 33 which abut the plates 25 are formed. Also the flanges 33 have a hole through which the bolt 26 extends. Thus by loosening the nut 27 the scraper holder 29 can be turned to a suitable angle with respect to the tool holder 18, after which it, by tightening the nut again, can be locked in this position. The scraper 24 can be exchanged easily by turning the locking plate 28 counterclockwise in FIG. 2 thereby disengaging the scraper. Turning in the opposite direction means that the scraper is locked in the scraper holder 29. Thus the scraper can quickly be exchanged when worn out. In order to adapt the nozzle to different kinds of surfaces, different types of scrapers can be used. For instance the scraper can be made out of steel, plastics, rubber or brush material and furthermore, the scraper might have a profile which directly corresponds to the surface. It should be mentioned that the scraper of course, could be a fixed part of the tool holder if this should be preferred.

By quickly changing between different kinds of tools the flexibility which is necessary to remove paint from different types of surfaces i.e. from a window, from moldings having different shapes, from smooth surfaces, and so on, is achieved. Preferably, in a first stage a scraper nozzle is used to clean the surface after which, in a second stage, a brush nozzle is used to suck away paint and additives residues, if any, and, if necessary, at the same time a rinsing agent such as water or means for neutralizing or for another purpose, is applied to the surface.

I claim:

1. A nozzle which via a hose is connected to a vacuum source for removing to a collecting container dissolved and scraped away paint residues from previously painted surfaces comprising a base part (10) connected to the hose, said base part having an opening (11) through which air together with dissolved paint residues are sucked, said base part having a supply means (13) for liquid through which a liquid is supplied to the nozzle in order to promote the transportation of the paint residues through the hose, a control device (15) by means of which the liquid supply to the nozzle can be adjusted, the nozzle further comprising a tool (18) which is exchangeably fastened to the base part (10) and is arranged to mechanically treat the surface from which the paint residues are sucked away, wherein the tool (18) is provided with a scraper (21), wherein the tool (18) includes a device for adjusting the angle of the scraper (24) with respect to the surface.

2. A nozzle according to claim 1, wherein the adjusting device comprises a scraper holder (29) which is turnably supported by the tool.

3. A nozzle according to claim 2 wherein the scraper holder (29) is U-shaped and has two legs and is supported on another holder (25) on the tool, the scraper (24) being inserted between the legs (31, 32) of the scraper holder and held in place by a locking plate (28) clamped between the legs.

4. A nozzle according to claim 3 wherein the locking plate has a bead (30) which when turning the plate forces one of the legs of the scraper holder in a direction toward the other leg of the scraper holder.

* * * * *